US006739292B1

(12) United States Patent
Neese

(10) Patent No.: US 6,739,292 B1
(45) Date of Patent: May 25, 2004

(54) TWO-STROKE INTERNAL COMBUSTION ENGINE WITH AIR INJECTION SYSTEM

(76) Inventor: Leroy Neese, 1635 Aquinas Ct., Burlington, NC (US) 27215

( * ) Notice: Subject to any disclaimer, the term of this patent is extended or adjusted under 35 U.S.C. 154(b) by 84 days.

(21) Appl. No.: 10/142,067

(22) Filed: May 9, 2002

(51) Int. Cl.[7] ..... F02B 33/00
(52) U.S. Cl. ..... 123/69 V
(58) Field of Search ..... 123/69 R, 69 V

(56) References Cited

U.S. PATENT DOCUMENTS

| | | | | |
|---|---|---|---|---|
| 3,821,941 A | * | 7/1974 | Rychlik | 123/65 WA |
| 4,732,116 A | | 3/1988 | Tanahashi et al. | 123/65 BA |
| 4,864,979 A | | 9/1989 | Eickmann | 123/65 BA |
| 5,020,504 A | | 6/1991 | Morikawa | 123/531 |
| 6,101,989 A | | 8/2000 | Green | 123/65 VC |
| 6,135,070 A | | 10/2000 | Crandall | 123/65 R |
| 6,170,444 B1 | * | 1/2001 | Ohlmann | 123/69 V |
| 6,182,449 B1 | | 2/2001 | Halimi et al. | 60/612 |

* cited by examiner

*Primary Examiner*—Mahmoud Gimie
*Assistant Examiner*—Arnold Castro

(74) *Attorney, Agent, or Firm*—Womble Carlyle Sandridge & Rice, PLLC; C. Robert Rhodes

(57) ABSTRACT

An improved two-stroke internal combustion engine is disclosed. The engine includes a cylinder having a cylindrical inner wall, a piston in the cylinder, and a cylinder head mounted atop a top end of the cylinder. The cylinder head includes a lower surface, at least one air supply channel, and at least one air intake opening and one air intake valve selectively closing the opening and configured to control the supply of intake air to the cylinder. The at least one intake opening and valve are positioned in the cylinder head along the air supply channel. An air compressor is connected to the channel for supplying compressed air to the cylinder through the at least one air intake valve. The at least one air intake valve is configured to open and permit the compressed air to enter the cylinder during a scavenging portion of the engine cycle, and to close when the piston is in a compression stroke. The at least one air intake opening is inclined at an angle relative to the axis of the cylinder such that the compressed air entering the cylinder is directed at least partially tangentially to the cylinder inner wall. The at least one valve and the cylinder inner wall cooperate to cause the air introduced into the cylinder to swirl in a substantially circular flowpath proximate the lower surface of the cylinder head.

1 Claim, 2 Drawing Sheets

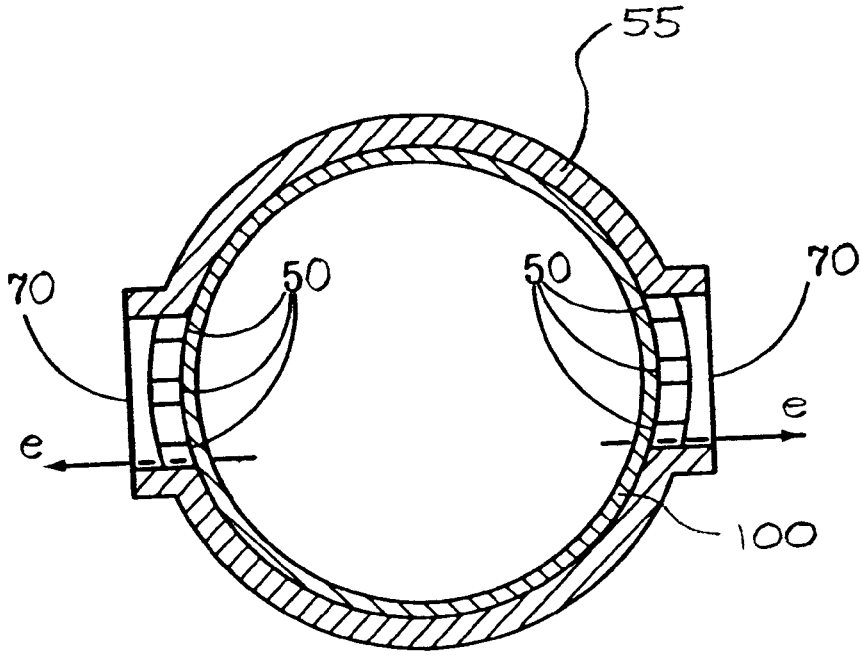
FIG. 3
FIG. 4
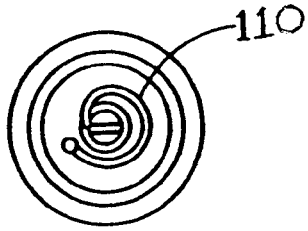

TWO-STROKE INTERNAL COMBUSTION ENGINE WITH AIR INJECTION SYSTEM

BACKGROUND OF THE INVENTION

Two stroke internal combustion engines have the potential to be more energy efficient than four-stroke engines because each downward stroke is a power stroke. Two stroke designs have not been fully fuel efficient, however, because they have not had effective fuel and air intake methods nor effective means of scavenging exhaust gases. Four stroke engines have the disadvantage of requiring energy to operate the extra two strokes, their camshafts, and their reciprocating valves. Further, neither current two stroke nor four stroke engines have ideal fuel vaporization processes.

The invention described herein relates to an improvement to the energy efficiency of the internal combustion engine using the two stroke concept and incorporating a more energy efficient method of introducing air into the cylinders and scavenging than that employed in previous designs. These functions can be accomplished with this new design as effectively as with the four stroke design, and this new design avoids the energy losses due to the two additional strokes of the four stroke engine. The invention also obviates the need for a camshaft and reciprocating valves, thus saving the energy required for their operation, and thereby increasing energy efficiency.

SUMMARY OF THE INVENTION

The energy efficiency of the internal combustion engine is improved with a unique two stroke design which uses the air pressure from a rotary compressor (centrifugal, axial-flow, etc.) to open the two air intake valves located in the cylinder head, and to force air into the cylinders for combustion and scavenging. The air is introduced substantially parallel to the inside bottom surface of the cylinder head, and the air is constrained by the cylinder walls and head configuration to swirl and rotate rapidly, thus flowing over the top of the combustion gases as the air enters the cylinder rather than mixing with the combustion gases. Scavenging is accomplished when the downwardly moving piston uncovers exhaust ports in the cylinder wall. The pressure from the expanding combustion gases in combination with the pressure of the air entering the cylinder from the rotary compressor causes the combustion gases to exit the cylinder through the exposed exhaust ports. The intake air which fills the cylinder during scavenging is then compressed for the next power stroke as the piston moves upward.

A fuel injector is located in the cylinder head and introduces fuel into the swirling air in the combustion chamber as the piston nears the top of its compression stroke. A spark plug is located in a position near the injector and ignites the fuel while the fuel-air mixture is rich. This arrangement permits the injection of a minimum quantity of fuel in order to achieve a maximum fuel economy. The air continues to swirl in the cylinder during ignition, burning, and scavenging, thereby further contributing to the efficiency of the engine.

Energy efficiency is enhanced by: 1) minimizing the energy expended to introduce air into the cylinders; 2) minimizing the quantity of fuel required for each power stroke through use of a more effective vaporization technique; 3) igniting a rich fuel-air mixture followed by burning as the air continues to swirl in the combustion chamber; 4) producing more rapid and complete burning; and 5) minimizing the energy expended to scavenge the exhaust gases from the cylinders. Further improvements in efficiency are accomplished by the elimination of reciprocating valves and the camshaft required by conventional four-stroke engines, and by eliminating the frictional losses inherent in the additional two strokes of four-stroke engines.

Because more complete burning of fuel is achieved due to the swirling of the air in the cylinder during burning, and because air from the rotary compressor contacts the combustion gases as the scavenging process occurs, exhaust pollutants from the engine are minimized. Consequently, there is less need for power-consuming anti-pollution devices like those currently employed on many four-stroke engines. Also, the exhaust system is configured to reduce exhaust sound, thereby reducing or eliminating the need for a muffler, and thereby avoiding back pressure from a muffler.

BRIEF DESCRIPTION OF THE DRAWINGS

FIG. 3 is a sectional view taken along line 3—3 as shown in FIG. 2; and FIG. 4 is a view of one of the valve shafts taken along line 4—4 as shown in FIG. 1.

DETAILED DESCRIPTION

Figure 1:
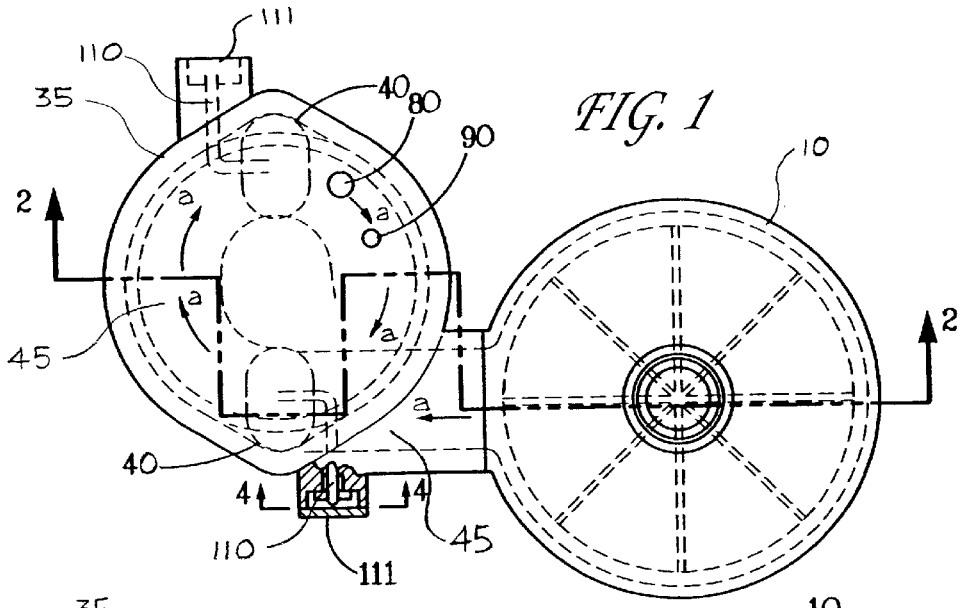
FIG. 1 is a top view of an engine according to the present invention showing the cylinder head and the centrifugal compressor.
Figure 2:
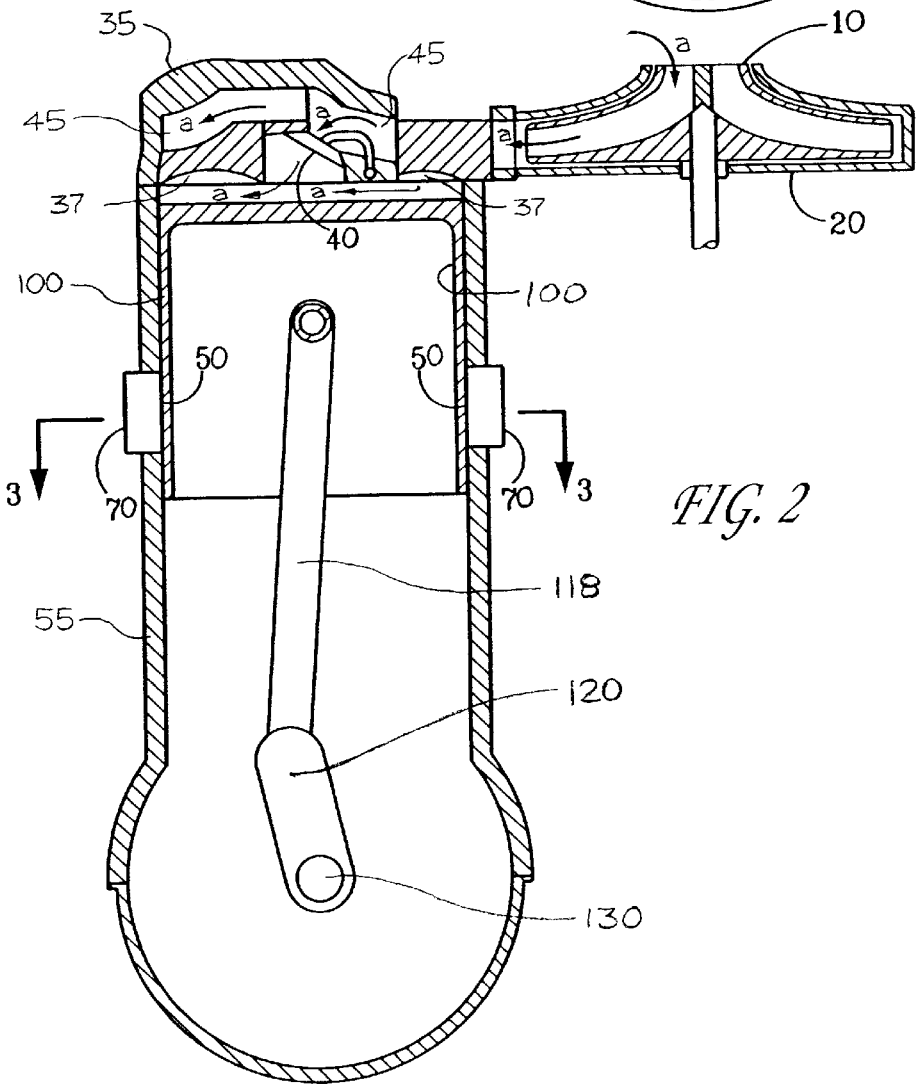
FIG. 2 is a sectional view taken along line 2—2 as shown in FIG. 1.

Referring now to the drawings in general and FIG. 1 in particular, it will be understood that the illustrations are for the purpose of describing a preferred embodiment of the invention and are not intended to limit the invention thereto. FIG. 1 shows the positions and configuration of air inlet valves 40 and an air flow channel in a cylinder head 35. The direction of flow of the intake air is indicated by arrows "a". Compressed air is introduced from a compressor 10 into air flow channel 45 in the cylinder head 35. The intake air passes through the channel 45 and enters the cylinder 55 through an air intake opening that is angled with respect to the longitudinal axis of the cylinder. As shown in FIG. 2, a valve 40 is positioned in each channel opening. The intake air is thereby introduced into the cylinder substantially parallel to the underside of the cylinder head 35 and substantially tangentially to the cylindrical inner walls of the cylinder 55. In addition, the bottom surface of the cylinder head may include a substantially circular trough 37 which enhances the swirling motion. The angled valves 40, the circular trough 37, and the cylindrical inner walls of the cylinder 55 cooperate to direct the intake air from the compressor 10 to swirl in a substantially circular flow path about the longitudinal axis of the cylinder 55 adjacent to the underside of the cylinder head 35. The flowpath of the intake air is indicated by arrows "a".

The positions of the fuel injector 80 and spark plug 90 in the cylinder head 35 are also shown in FIG. 1. The fuel injector 80 is positioned to inject fuel into the swirling air stream to enhance the mixing of the fuel with the intake air. The spark plug 90 is located near the fuel injector 80 and downstream therefrom, thereby providing ignition while the fuel-air mixture is still rich and before the fuel fully dissipates in the combustion chamber. After the fuel is ignited, the continued swirling of the air enhances burning of the fuel. This arrangement is conducive to better ignition and more complete burning of the fuel, thereby permitting the injection of a minimum quantity of fuel for each power stroke and thereby increasing energy efficiency.

FIG. 2 shows the relationship of a cylinder 55, a piston 100, a connecting rod 118, a crank 120, a crankshaft 130, exhaust ports 50, exhaust manifold mounting surfaces 70, the cylinder head 35, and the compressor 10 with compressor housing 20. The piston 100 is shown near the top of a compression stroke, and air inlet valve 40 is shown in a closed position. The air inlet valves 40 are resiliently mounted in the cylinder head 35 as shown in FIGS. 1 and 4. The valves 40 are configured to automatically open and close responsive to cyclic pressure differentials across the valves 40. Arrows "a" indicate the flow of air through the compressor 10, through channel 45 and valve 40, and into the cylinder 55. The air for combustion and scavenging flows from the centrifugal compressor 10 into the channel 45. Pressure from the compressor causes air intake valves 40 to open substantially simultaneously during scavenging, thereby permitting air to flow into the cylinder 55 over the top of the combustion gases. Air pressure together with the swirling motion of the air in the top of the cylinder 55 compels the combustion gases to pass from the cylinder 55 through the exhaust ports 50 as shown in FIGS. 2 and 3. The direction of flow of the exhaust gases is indicated by arrows "e".

The compressor 10 illustrated in FIGS. 1 and 2 is a rotary compressor. Alternatively, the compressor 10 may be a multistage compressor, an axial flow compressor, or any other compressor suitable for delivering compressed air into the cylinder 55. The compressor 10 may be driven by either a belt or gear arrangement from the crankshaft 130 (not shown).

FIG. 2 shows the piston 100 in a position at the beginning of a power stroke. A power stroke involves about a 120° rotation of the crankshaft 130. The power stroke is completed when the top of the piston 100 reaches the top of the exhaust ports 50 in sides of the cylinder 55. The exhaust ports 50 are uncovered by the piston 100 for scavenging during a second rotation of the crankshaft 130 of about 120°. Pressure inside the cylinder 55 decreases as the combustion gases begin to flow out through the exhaust ports 50 as indicated by arrows "e" in FIG. 3. Substantially concurrently, the pressure from the compressor 10 causes the air inlet valves 40 to open. The pressure of the incoming air from the rotary compressor 10 and the force of the rapidly swirling gases urges the combustion gases to exit through the exhaust ports 50. During the entire scavenging portion of the cycle, air enters the combustion chamber from the compressor 10 through the open valves 40, is constrained to a swirling motion, and glides over the top of the combustion gases, thereby minimizing the amount of mixing with the combustion gases. Thus, the combustion chamber is substantially depleted of exhaust gases in preparation for the next power stroke. The swirling action of the air also provides for optimum vaporization of the fuel, and thereby results in effective burning and consequent energy efficiency.

Compression of the air in the combustion chamber is accomplished by the upward movement of the piston as the crankshaft 130 rotates through about the final third of its rotation. As this third portion of the crankshaft rotation begins, the air pressure in the cylinder increases until the pressure exceeds the pressure of the air being supplied by the compressor 10. The resulting pressure differential across the valves 40 causes the valves 40 to close.

FIG. 4 shows the mounting of the valves 40 in the cylinder head 35 with valve springs 110. The valve springs 110 are anchored to the cylinder head 35 as shown. The springs 110 hold the valves 40 in closed positions when the engine is not running. The springs 110 also assist to close the valves 40 after the scavenging portion of the cycle is completed. The springs 110 are configured to allow the valves 40 to open with very little resistance as the air intake and scavenging functions occur in the cycle. The valve spring mechanism 110 is accessed by removal of a cover 111.

While this invention has been illustrated and described in accordance with a preferred embodiment, it is recognized that variations and changes may be made therein without departing from the invention as set forth in the claims. Certain modifications and improvements will occur to those skilled in the art upon a reading of the forgoing description. For example, while the engine has been described above as having only one cylinder and piston, an engine according to the invention may include two or more cylinders and pistons as described, with each of the pistons coupled to a common crankshaft. It should be understood that all such modifications are not contained herein for the sake of conciseness and readability, but are properly within the scope of the following claims.

I claim:

1. A two-stroke internal combustion engine comprising:

(a) a cylinder having a cylindrical inner wall, an upper end, and a longitudinal axis;

(b) a piston in the cylinder;

(c) a cylinder head mounted atop the upper end of the cylinder and comprising:
  (i) a lower surface;
  (ii) at least one air supply channel in the head;
  (iii) at least one air intake opening and one air intake valve selectively closing the opening and configured to control the supply of intake air to the cylinder, the at least one intake opening and valve being positioned in the cylinder head along the at least one air supply channel in the cylinder head;

(d) an air compressor connected to the air supply channel for supplying compressed air to the cylinder through the at least one air intake valve; and (e) a substantially circular trough in the lower surface of the cylinder head, the trough being substantially concentric with the longitudinal axis of the cylinder;

(e) wherein the at least one air intake valve is configured to open and permit the compressed air to enter the cylinder during a scavenging portion of an engine operational cycle and to close during a compression portion of the engine operational cycle, the air intake opening includes an axis which is inclined at an angle relative to the longitudinal axis of the cylinder such that the compressed air entering the cylinder is directed at least partially tangentially to the cylinder inner wall, and the trough is configured to cooperate with the at least one valve and the inner wall of the cylinder to direct the air introduced into the cylinder to swirl in a substantially circular flowpath proximate to the lower surface of the cylinder head.

* * * * *